US007762334B2

(12) United States Patent
Posluszny et al.

(10) Patent No.: US 7,762,334 B2
(45) Date of Patent: Jul. 27, 2010

(54) ECCENTRICALLY-DISPOSED CHOKE INJECTOR

(75) Inventors: Andrew C. Posluszny, Friendswood, TX (US); Bunker M. Hill, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 308 days.

(21) Appl. No.: 11/163,910

(22) Filed: Nov. 3, 2005

(65) Prior Publication Data

US 2007/0095539 A1 May 3, 2007

(51) Int. Cl.
*E21B 37/00* (2006.01)

(52) U.S. Cl. ..... 166/312; 166/334.4; 166/242.1

(58) Field of Classification Search ..... 166/312, 166/334.4, 242.1
See application file for complete search history.

(56) References Cited

U.S. PATENT DOCUMENTS

| | | | | |
|---|---|---|---|---|
| 4,558,742 | A * | 12/1985 | Huang et al. | 166/278 |
| 4,601,342 | A | 7/1986 | Pringle | |
| 5,020,592 | A | 6/1991 | Muller et al. | |
| 5,190,106 | A | 3/1993 | Johnston | |
| 6,631,767 | B2 | 10/2003 | Pringle et al. | |
| 6,860,330 | B2 * | 3/2005 | Jackson | 166/332.1 |
| 7,147,054 | B2 * | 12/2006 | Wang et al. | 166/278 |
| 2002/0027003 | A1 * | 3/2002 | Williamson et al. | 166/240 |
| 2004/0112608 | A1 * | 6/2004 | Jackson | 166/373 |

FOREIGN PATENT DOCUMENTS

| | | |
|---|---|---|
| GB | 2396633 A | 6/2004 |
| RU | 2223391 | 2/2004 |
| RU | 2233970 | 8/2004 |
| WO | 99/05387 A2 | 2/1999 |
| WO | 03083256 A1 | 10/2003 |

* cited by examiner

*Primary Examiner*—Shane Bomar
(74) *Attorney, Agent, or Firm*—Rodney V. Warfford; Trop, Prunner & Hu, P.C.

(57) ABSTRACT

An apparatus that is usable with a well includes a tool and a shroud. The tool is to be disposed in a wellbore and includes an opening to inject fluid into the well. The shroud at least partially surrounds the tool to eccentrically dispose the tool with respect to a longitudinal axis of the wellbore.

18 Claims, 5 Drawing Sheets

ECCENTRICALLY-DISPOSED CHOKE INJECTOR

BACKGROUND

The invention generally relates to an eccentrically-disposed choke injector.

A choke injector is a well tool, which typically is used for purposes of injecting a fluid, such as sea water, into the annulus of the well. As its name implies, the choke injector typically has a controllable flow rate. However, a challenge with using the choke injector is that the fluid that exits its radially-directed openings may erode a casing of the well.

Thus, there is a continuing need for a choke injector that is less harmful to a well casing.

SUMMARY

In an embodiment of the invention, an apparatus that is usable with a well includes a tool and a shroud. The tool is to be disposed in a wellbore and includes a opening to inject fluid into the well. The shroud at least partially surrounds the tool to eccentrically dispose the tool with respect to a longitudinal axis of the wellbore.

In another embodiment of the invention, a technique that is usable with a well includes providing a tool in a wellbore to inject fluid into the well via an opening of the tool. The technique includes eccentrically disposing the tool with respect to a longitudinal axis of the wellbore to reduce a velocity of fluid that impacts a casing of the well.

In yet another embodiment of the invention, a system that is usable with a well includes a shroud and a string that includes a choke injector. The string and choke injector are to be disposed in a wellbore, and the choke injector includes openings to inject fluid into the well. The shroud at least partially surrounds the choke injector to eccentrically dispose the choke injector with respect to a longitudinal axis of the wellbore.

Advantages and other features of the invention will become apparent from the following drawing, description and claims.

DETAILED DESCRIPTION

Figure 1:
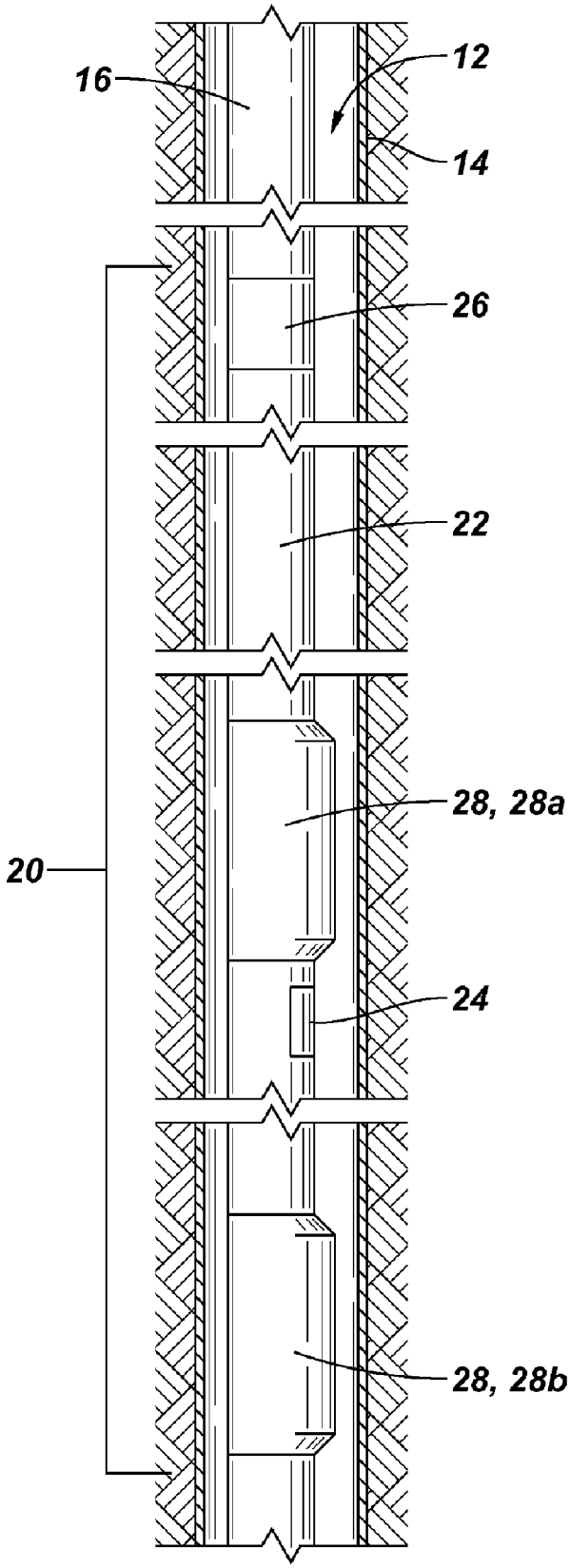
FIG. 1 is a schematic diagram of a well according to an embodiment of the invention.

Referring to FIG. 1, in accordance with an embodiment of the invention, a well (a subterranean or subsea well) includes a tubular string 16, which contains a choke injector (part of a choke injector assembly 20 of the string 16), a tool that may be used to radially inject fluid (sea water, for example) into the well. Unlike conventional choke injectors, the choke injector is eccentrically-disposed with respect to a longitudinal axis of the wellbore. As described below, due to the eccentric positioning of the choke injector, the openings of the choke injector are positioned far enough from a casing 14 to minimize damage to the casing 14 due to the injection of fluid from the openings.

In accordance with some embodiments of the invention, the eccentric positioning of the choke injector is accomplished via outer shrouds 28 (shrouds 28*a* and 28*b* being depicted in FIG. 1 as examples) of the choke injector assembly 20, which generally radially extend outwardly from the string 16. Each shroud 28 has a non-uniform radial thickness in that each shroud 28 is radially thicker over a certain continuous range of angles about the longitudinal axis of the assembly 20 than the radial thickness around the remainder of the shroud 28.

As noted above, the eccentricity of the choke injector maximizes the distance that fluid travels (after exiting its openings) before reaching the casing 14, as compared to a conventional choke injector that is concentric with respect to the longitudinal axis of the wellbore. Due to this additional distance that the exiting fluid travels, the velocity of the fluid is reduced, thereby reducing, if not preventing, erosion of the casing 14 due to contact of the fluid with the casing 14.

As depicted in FIG. 1, the casing 14 generally lines a wellbore 12, which receives the string 1 6 and the choke injector assembly 20. The choke injector is formed from at least an inner choke sleeve (not depicted in FIG. 1 and depicted as reference numeral "50 "in FIGS. 2-6) and an outer tubular choke housing 22. The inner choke sleeve is designed to longitudinally travel inside the outer choke housing 22 to regulate the outward fluid flow from the choke injector. The inner choke sleeve includes radial ports, or openings, that when exposed through one or more windows 24 (one window 24 being depicted in FIG. 1 and multiple windows 24 being depicted in FIG. 4) of the outer choke housing 22, inject fluid into the well. The number of openings that are exposed through the window(s) 24 are a function of the choke design and position of the internal choke sleeve.

The longitudinal position of the internal choke sleeve (relative to the outer choke housing 22) may be mechanically manipulated from the surface of the well in accordance with some embodiments of the invention. However, in accordance with other embodiments of the invention, the choke assembly 20 includes an actuator 26, which may be remotely controlled from the surface of the well for purposes of longitudinally moving the internal choke sleeve up and down inside the choke housing 22 to control the fluid flow from the choke injector.

The actuator 26 may be controlled by a hydraulic control line, in some embodiments of the invention. Alternatively, in other embodiments of the invention, the actuator 26 may be controlled via other mechanisms, such as through, for example, a wired connection (an electrical or optical cable, for example) between the actuator 26 and the surface of the well. In other embodiments of the invention, the actuator 26 may be controlled through wireless stimuli that are communicated to the actuator 26 from the surface of the well. As examples, the wireless stimuli may include fluid pressure pulses, acoustic waves, electromagnetic waves, etc., depending on the particular embodiment of the invention.

Figure 2:
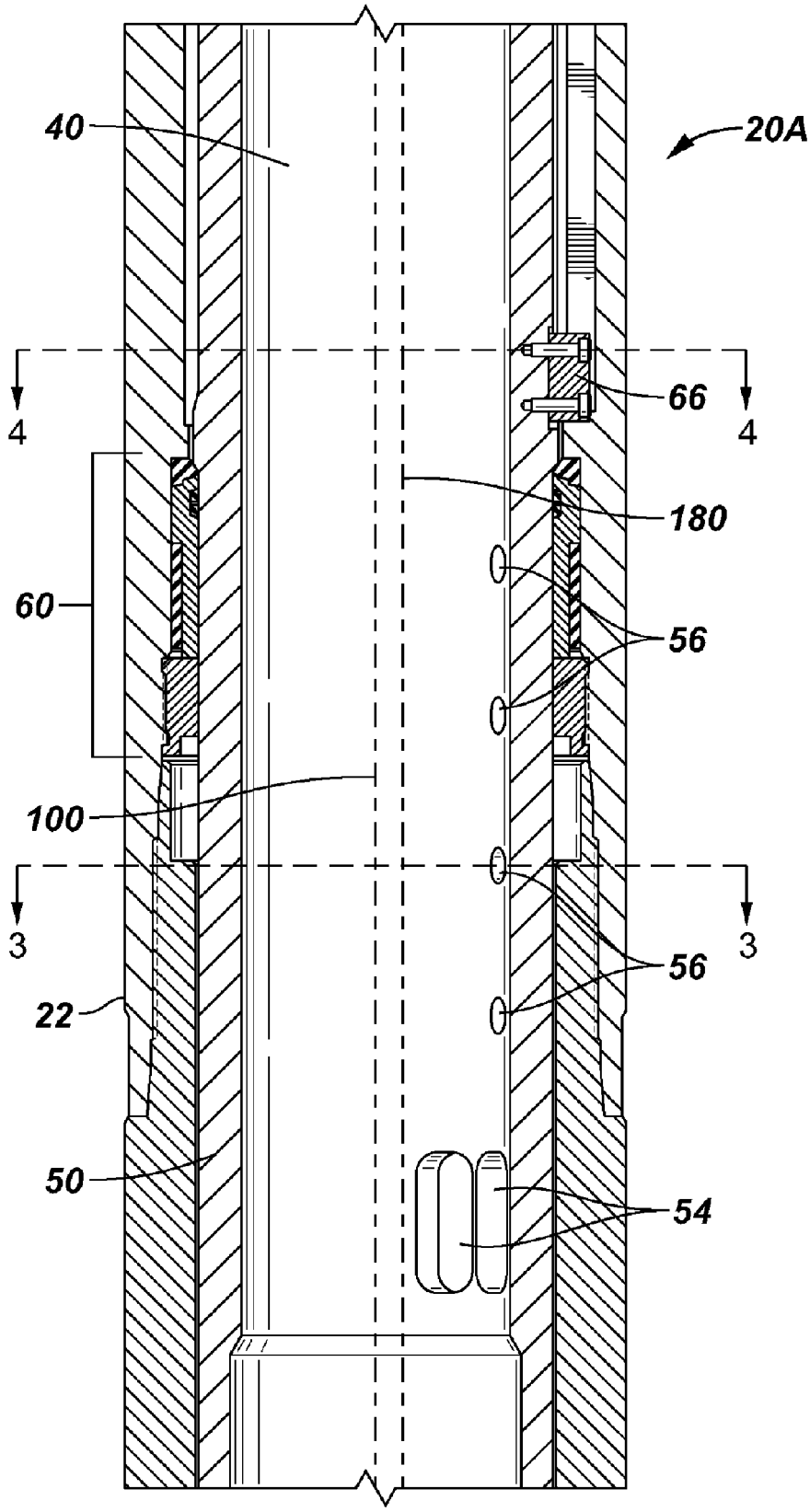
FIGS. 2 and 5 are schematic diagrams of different sections of a choke injector assembly of FIG. 1 according to an embodiment of the invention.
Figure 5:
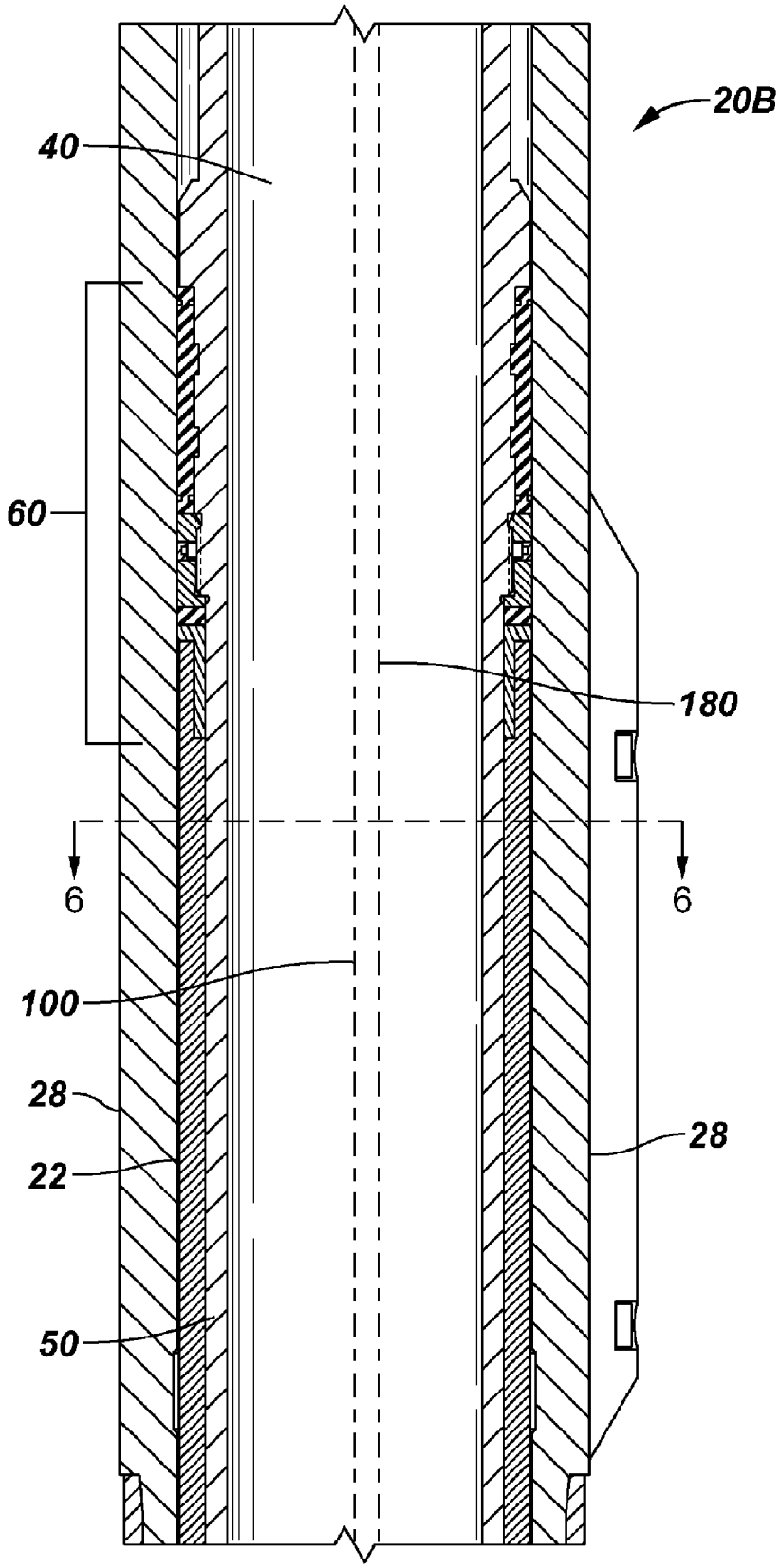

FIGS. 2 and 5 depict exemplary lower 20A and upper 20B sections, respectively, of the choke injector assembly 20 according to some embodiments of the invention. The depiction of the sections 20A and 20B are for purposes of example and are not intended to limit the scope of the appended claims. For example, in other embodiments of the invention, the choke injector assembly 20 may include sections in addition those depicted in the figures, which include additional sets of openings and choking sections that are part of the same internal choke sleeve. Thus, many variations are possible and are within the scope of the appended claims.

Referring to FIGS. 2 and 5, in accordance with some embodiments of the invention, the choke injector assembly 20 includes a choke injector and one or more shrouds 28. The choke injector, which may be viewed as being formed from an inner choke sleeve 50 and the outer choke housing 22, is concentric about a longitudinal axis 100 (see also FIG. 6); and the choke injector assembly 20 is concentric about a longitudinal axis 180 (see also FIG. 6).

The inner choke sleeve 50 is designed to move up and down longitudinally with respect to the outer choke housing 22 for purposes of regulating the flow that exits the choke injector. As depicted in FIG. 2, the inner choke sleeve 50 includes a central passageway 40 for purposes of communicating fluid from the surface of the well, and some of this fluid, depending on the state of the choke injector, may be communicated radially into the well.

The internal choke sleeve 50 includes radial ports, or openings 54 and 56. As shown in FIG. 2, the openings 54 may have generally larger cross-sectional flow areas than the openings 56. Thus, in accordance with some embodiments of the invention, the actuator 26 moves the inner choke sleeve 50 to expose (at the window(s) 24 (see FIG. 1) of the outer choke housing 22) the openings 54 to establish a larger radial flow from the choke injector and moves the internal choke sleeve 50 to expose the smaller openings 56 in the window(s) 24 for a reduced flow from the choke injector. For purposes of placing the choke injector in its closed state, the actuator 26 positions the internal choke sleeve 50 so that no radial opening is exposed at the window 24.

As depicted in FIG. 2, one or more seal assemblies 60 may be formed between the inner surface of the outer choke housing 22 and the outer surface of the inner choke sleeve 50 for purposes of forming fluid seals between the choke sleeve 50 and the outer choke housing 22.

Figure 4:
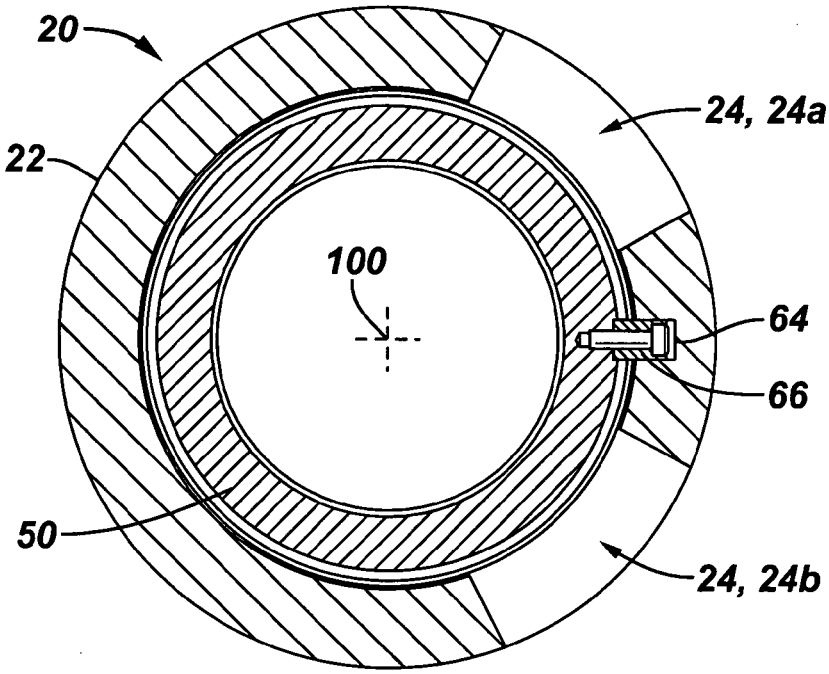
FIG. 4 is a cross-sectional view taken along line 4-4 of FIG. 2 according to an embodiment of the invention.

The openings 54 and 56 are radially directed away from the inner choke sleeve 50 at angles that coincide with the eccentric portions of the shrouds 28. Thus, the openings 54 and 56 are oriented at angles within a continuous range of angles that spans across the eccentric portions of the shrouds 28. Therefore, as depicted in FIG. 2, the openings 54 to 56 are oriented to take advantage of the eccentric positioning of the choke injector 20. Referring also to FIG. 4 (which depicts a cross-section of the choke injector taken along line 4-4 of FIG. 2), for purposes of orienting the openings 54 and openings 56 at the proper angle, in accordance with some embodiments of the invention, the choke injector includes a radially-extending guide 66 that resides in a longitudinal slot 64, a slot that is exposed in the inner surface of the outer choke housing 22. Thus, the slot 64 and guide 66 angularly orient the openings 54 and 56 to coincide with the eccentric portions of the shrouds 28.

Figure 3:
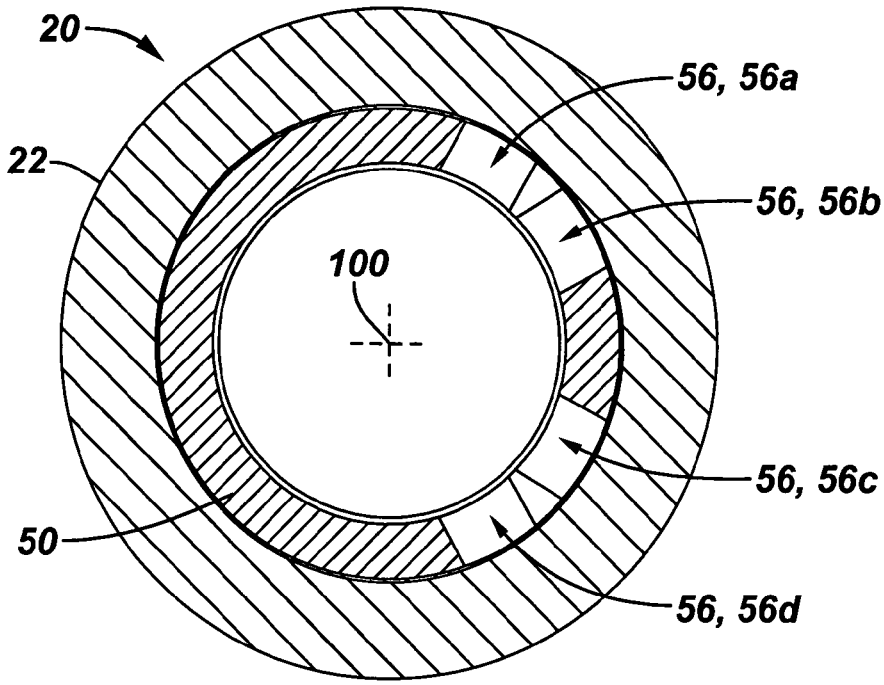
FIG. 3 is a cross-sectional view taken along line 3-3 of FIG. 2 according to an embodiment of the invention.

FIG. 3 is a cross-sectional view depicting the angular orientations of the openings 56. The inner choke sleeve 50 and the outer choke housing 22 are generally concentric about the longitudinal axis 1 00, and the openings 56 (by virtue of the slot 64 and guide 66 arrangement (FIG. 2) radially extend from the longitudinal axis 100 and are oriented at angles that coincide with the eccentric portions of the shrouds 28, as further discussed below.

Referring to FIG. 2 in conjunction with FIGS. 3 and 4, openings 56*a* and 56*b* (FIG. 3) of the choke injector are, by virtue of the slot 64 and guide 66 arrangement, angularly aligned to longitudinally slide (when so positioned by the actuator 26) into a window 24a (FIG. 4) in the outer choke housing 22; and openings 56*c* and 56*d* (FIG. 3) are likewise angularly aligned to longitudinally slide (when so positioned by the actuator 26) into a window 24*b* (FIG. 4) in the outer choke housing 22.

Figure 6:
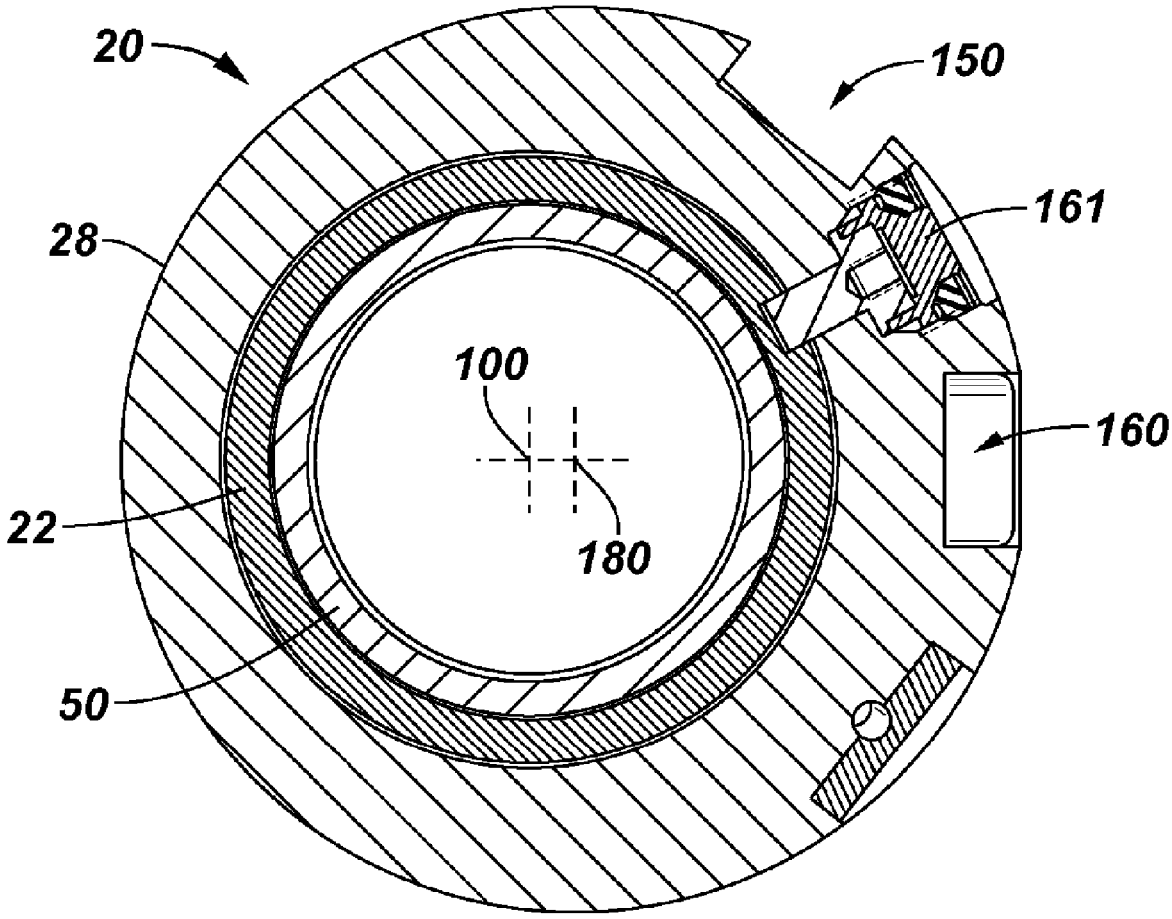
FIG. 6 is a cross-sectional view taken along line 6-6 of FIG. 5 according to an embodiment of the invention.

FIG. 6 depicts a cross-section of the choke assembly 20, taken along line 6-6 of FIG. 5. As illustrated in FIG. 6, with the eccentrically-disposed shrouds 28, the longitudinal axis 180 of the choke injector assembly 20 is offset from a longitudinal axis 100 of the choke injector (formed from the inner choke sleeve 50 and the outer choke housing 22). If the outer diameter of the choke injector 22 is close to the inner diameter of the casing string 14 then the casing 14 (not shown in FIG. 6) is also generally symmetric about the longitudinal axis 180. Because the longitudinal axis 100 of the choke injector is offset from the longitudinal axis 180, the choke injector is eccentric with respect to the well casing 14.

Referring to FIG. 6, among the other features of the choke injector assembly 20, in accordance with some embodiments of the invention, the shroud 28 includes one or more longitudinal passageways 150 and 160 for purposes of routing cables and control lines downhole. In this regard, the shroud 28 may include, for example, an internal longitudinal passageway 160, as well as include channels 150 that are exposed on the outer surface of the shroud 28. As also depicted in FIG. 6, one or more indexer pins 161 may radially extend between shroud 28 and the outer choke housing 22.

Although terms of direction and orientation, such as "up," "down," "vertical," etc. have been used in the following description to describe certain embodiments of the invention, it is understood that these directions and orientations are not needed to practice the invention. For example, in other embodiments of the invention, the choke assembly 20 may be used in a vertical or lateral wellbore. As another example, in other embodiments of the invention, the choke injector may move in an upward direction to progressively open radial fluid communication and conversely, operate in a downwardly direction to progressively close off the radial fluid communication. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

an injector tool to be disposed in a wellbore and comprising an opening to inject fluid into the well;

a shroud to at least partially surround the tool to eccentrically dispose the tool with respect to a longitudinal axis of the wellbore; and an actuator to angularly align the opening within a radially thicker portion of the shroud in response to actuation of the actuator;

wherein the radially thicker portion extends over a first range of angles about a longitudinal axis of the tool, and the opening is oriented at an angle that falls within the first range.

2. The apparatus of claim 1, wherein the shroud is adapted to reduce a velocity of the fluid by maximizing a distance that the fluid travels before striking a casing of the well as compared to a tool that is concentrically disposed with respect to the wellbore.

3. The apparatus of claim 1, wherein the opening is oriented to generally maximize a distance that the fluid travels before the fluid strikes a casing of the well.

4. The apparatus of claim 1, wherein the shroud comprises a portion eccentrically disposed with respect to the longitudinal axis of the tool, and the opening is oriented at an angle that coincides with said portion of the shroud.

5. The apparatus of claim 1, wherein the tool comprises a choke injector.

6. The apparatus of claim 1, wherein the tool comprises: a choke housing; and an inner choke sleeve disposed in the choke housing.

7. The apparatus of claim 6, wherein the choke housing is concentric with respect to the inner choke sleeve.

8. The apparatus of claim 6, wherein the inner choke sleeve includes the opening, the inner choke sleeve longitudinally slides in the choke housing, and the choke housing comprises a window to expose the opening when the inner choke sleeve moves to a given longitudinal position.

9. The apparatus of claim 6, wherein the tool comprises an actuator to move the inner choke sleeve with respect to the choke housing.

10. A method usable with a well, comprising:

providing a tool in a wellbore to inject fluid into the well via an opening of the tool;

regulating a velocity of fluid injected by the tool into an annulus of the well and which impacts a casing of the well, comprising placing a shroud at least partially around the tool to eccentrically dispose the tool with respect to a longitudinal axis of the wellbore, the shroud having a radially thicker portion that extends over a first range of angles about a longitudinal axis of the tool; and wherein the act of regulating the velocity comprises actuating an actuator of the tool to orient the opening to coincide with the radially thicker portion so that the opening is at an angle that falls within the first range.

11. The method of claim 10, wherein the act of regulating the velocity comprises: extending a distance that the fluid travels before the fluid strikes the casing relative to a tool that is substantially concentric to the longitudinal axis of the wellbore.

12. The method of claim 10, wherein the act of regulating the velocity comprises: placing a shroud at least partially around the tool, the shroud having a portion eccentrically disposed with respect to the longitudinal axis of the tool, the method further comprising: orienting the opening at an angle that coincides with said portion of the shroud.

13. The method of claim 10, wherein the tool comprises a choke injector.

14. The method of claim 10, further comprising:

selectively moving an inner sleeve of the tool with respect to an outer housing of the tool to control the injection of fluid by the opening.

15. A system usable with a well, comprising:

a string comprising a choke injector to be disposed in a wellbore and comprising openings to inject fluid into the well;

a housing to at least partially surround the choke injector to eccentrically dispose the choke injector with respect to a longitudinal axis of the wellbore; and an actuator to angularly align the openings within a radially thicker portion of the housing in response to actuation of the actuator;

wherein the radially thicker portion extends over a first range of angles about a longitudinal axis of the choke injector, and the openings are oriented at angles that fall within the first range.

16. The system of claim 15, wherein the housing is adapted to maximize a distance that the fluid travels from the openings before the fluid impacts a casing of the well to reduce a velocity of the fluid from each opening relative to a tool that is concentric with the wellbore.

17. The system of claim 15, wherein the openings are oriented to generally maximize a distance that the fluid travels from the openings before the fluid impacts a casing of the well.

18. The system of claim 15, wherein the housing comprises a portion eccentrically disposed with respect to the longitudinal axis of the choke injector, and the openings are oriented at angles that coincide with said portion of the housing.

* * * * *